US008631867B2

(12) United States Patent
Gordy et al.

(10) Patent No.: US 8,631,867 B2
(45) Date of Patent: Jan. 21, 2014

(54) METHODS FOR COOLING MEASURING DEVICES IN HIGH TEMPERATURE WELLS

(75) Inventors: Darrell Gordy, New Iberia, LA (US); Dwight D. Fulton, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 187 days.

(21) Appl. No.: 12/645,483

(22) Filed: Dec. 23, 2009

(65) Prior Publication Data

US 2010/0155058 A1 Jun. 24, 2010

Related U.S. Application Data

(60) Provisional application No. 61/140,250, filed on Dec. 23, 2008.

(51) Int. Cl.
*E21B 47/01* (2012.01)

(52) U.S. Cl.
USPC ..... 166/254.2; 166/250.1; 166/302; 166/57

(58) Field of Classification Search
USPC ..... 166/254.2, 250.1, 302, 57
See application file for complete search history.

(56) References Cited

U.S. PATENT DOCUMENTS

| | | | | |
|---|---|---|---|---|
| 4,479,383 | A | 10/1984 | Bravenec | |
| 4,559,790 | A | 12/1985 | Houston | |
| 4,570,709 | A * | 2/1986 | Wittrisch | 166/254.2 |
| 5,217,075 | A | 6/1993 | Wittrisch | |
| 7,246,940 | B2 | 7/2007 | Storm et al. | |
| 2006/0081412 | A1 * | 4/2006 | Wright et al. | 181/104 |
| 2006/0117759 | A1 | 6/2006 | Hall | |
| 2006/0144619 | A1 * | 7/2006 | Storm et al. | 175/17 |

* cited by examiner

*Primary Examiner* — William P Neuder
*Assistant Examiner* — Richard Alker
(74) *Attorney, Agent, or Firm* — W Schmidt

(57) ABSTRACT

A method for monitoring a fracturing operation in a target well comprising extending a seismic sensor in a tubing string to a first position in an well offset from the target well. A coolant fluid is circulated through the tubing string for a predetermined time. The tubing string is retracted to a second uphole position such that the cooled seismic sensor is exposed in the offset wellbore. A seismic signal emitted during the fracturing operation of the target well is sensed in the offset well.

9 Claims, 7 Drawing Sheets

METHODS FOR COOLING MEASURING DEVICES IN HIGH TEMPERATURE WELLS

CROSS-REFERENCE TO RELATED APPLICATIONS

This application claims priority from U.S. Provisional Application 61/140,250 filed on Dec. 23, 2008, which is incorporated herein by reference.

BACKGROUND

The present disclosure is generally directed to well completions and more particularly to monitoring well completions in high temperature wells.

Microseismic signals may be emitted during formation fracturing in downhole wells. The monitoring of such emissions in high temperature wells causes significant problems. Such high temperatures downhole are of particular concern as such temperatures, which may exceed 150° C., cause a shorter performance life in electrical components, and may cause such components to fail completely. In addition, heat generated by the electrical components themselves may contribute to overheating and associated failure to function. These high temperature electronics issues may be even more serious in microseismic monitoring due to the low signal levels.

BRIEF DESCRIPTION OF THE DRAWINGS

A better understanding of the present invention can be obtained when the following detailed description of example embodiments are considered in conjunction with the following drawings, in which.

Figure 1:
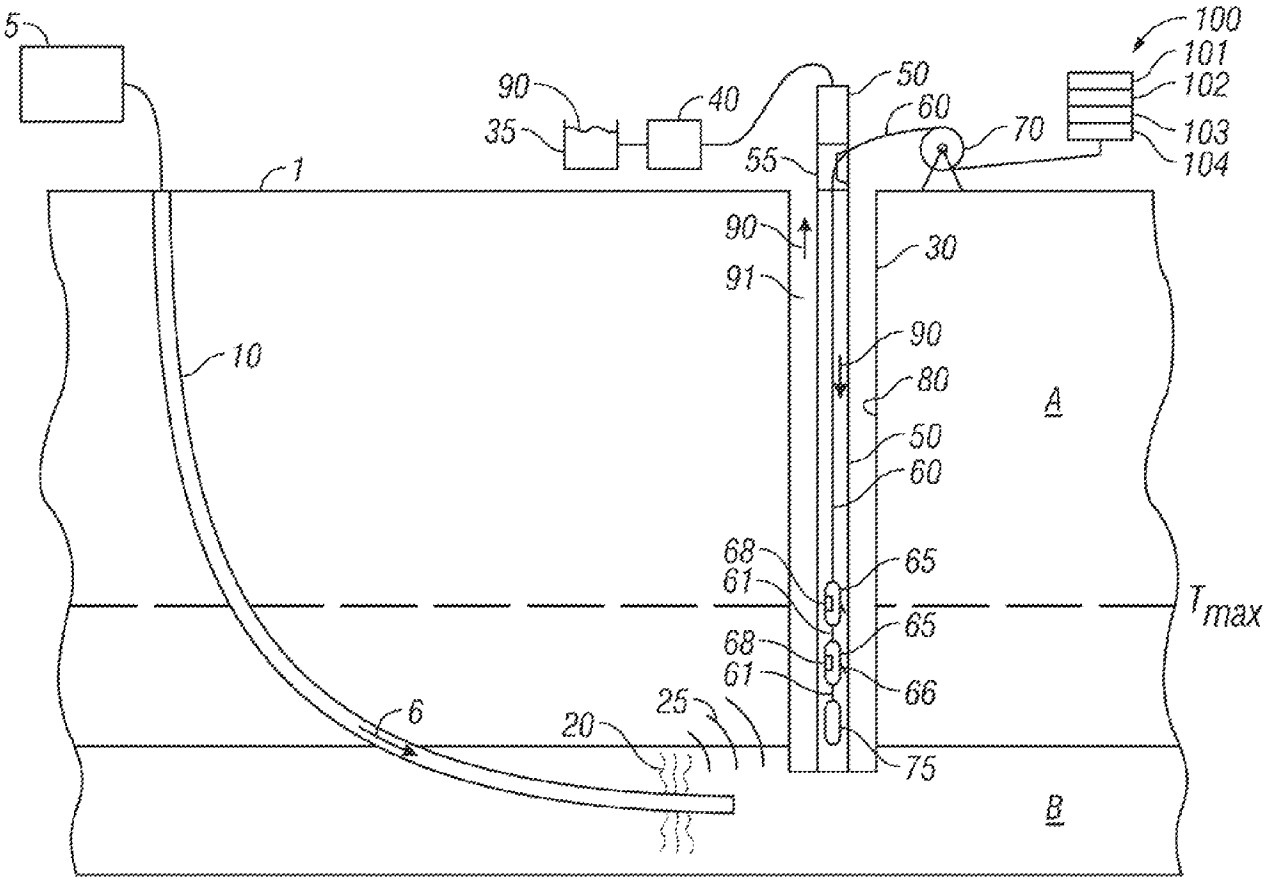
FIG. 1 illustrates an example of a system for monitoring the fracture of a high temperature formation.

While the invention is susceptible to various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the intention is to cover all modifications, equivalents and alternatives falling within the scope of the present invention as defined by the appended claims.

DETAILED DESCRIPTION

Described below are several illustrative embodiments of the present invention. They are meant as examples and not as limitations on the claims that follow.

In one embodiment, the present invention relates to the monitoring of the fracturing of formations surrounding a wellbore by detecting microseismic signals generated by the fracturing of the formation. As used herein, microseismic signals refer to acoustic signals, or emissions, generated by changes in stress in the formation caused by the injection of fluids and other materials during the hydraulic fracturing of the formation.

FIG. 1 illustrates an example of a system for monitoring the fracturing of a high temperature formation. As shown therein, a production well 10 extends through a first formation A and into a producing formation B. In order to enhance production of the portion of formation B surrounding well 10, it may be desirable to fracture formation B to increase the flow of hydrocarbon fluids to well 10. Hydrocarbon fluids may include oil, gas, and mixtures thereof. To fracture formation B, pump 5 may pump a fracturing fluid 6 down well 10 using techniques and equipment known in the art. As the fracturing pressure is increased in the area to be fractured, the stresses in the surrounding formation rock matrix increase, generating fractures 20 in formation B. The increased stress and subsequent fractures emit microseismic signals 25. The detection of these signals provides information related to the effectiveness of the fracturing operation. Multiple fracturing procedures may be carried out at different locations along well 10.

In order to detect the microseismic emissions, seismic receivers 65 may be lowered on wireline 60 into an offset well 30 to a suitable depth for monitoring the fracturing process. In one example, as shown in FIG. 1, offset well 30 has casing 80 installed therein. Tubing string 50 is insertable into offset well 30. Tubing string 50 may comprise jointed tubing and/or coiled tubing. A side entry sub 55 is located in tubing string 50.

Side entry sub 55 allows wireline 60 to be fed into tubing string 50 and allows the movement of wireline 60 relative to tubing string 50, as will be described below. Side entry subs are known in the art and are not described here in detail.

Wireline 60 may be extended and retracted using reel 70. At least one seismic receiver 65 is attached to wireline 60 and is movable relative to tubing string 50. In one embodiment a plurality of seismic receivers 65 are spaced apart at predetermined locations along wireline 60. Wireline 60 may comprise electrical and/or optical conductors for supplying power and enabling data communication between a surface controller 100 and seismic receivers 65. In one embodiment, surface controller 100 may comprise a processor 101 in data communication with a memory 102 and a mass storage device 103. Surface controller 100 may also comprise interface and power circuits 104 for powering and interfacing with seismic receivers 65 and sensor sub 75.

Seismic receivers 65 may comprise one or more sensors for detecting seismic signals 25. In one example, seismic receiver 65 comprises a three component geophone for detecting seismic signals 25. Such geophones are commercially available, for example the model ASR-1 provided by Avalon Sciences Ltd. of Somerton, Somerset, UK. Alternatively, any other suitable seismic receiver may be used in the present invention. Seismic receiver 65 may also comprise suitable interface and communications circuits (not shown) to be operationally controlled by surface controller 100. Seismic receiver 65 may also comprise a temperature sensor 68 that indicates an internal temperature that can be related to the temperature of the internal electronics circuits. Temperature sensor 68 may be a resistance temperature sensor, a thermostat, or any other suitable temperature sensor. Seismic receiver 65 may also comprise a locking arm 66 that controllably extends out from the body of seismic receiver 65 to contact the wall of tubing 50 or casing 80 to lock each seismic receiver 65 in place. In one embodiment, locking arm 66 is controlled by surface controller 100.

Sensor sub 75 may be attached below seismic receivers 65. Sensor sub 75 may comprise sensors including, but not limited to: a wellbore fluid temperature sensor; and a casing collar locator. Such sensors are well known in the art, and are not described here in detail. The temperature sensor and the casing collar sensor may be in data communication with surface controller 100 via wireline 60. Sensor sub 75 may be connected mechanically and electrically to the bottom seismic receiver by umbilical 61. Likewise, multiple seismic receivers may be mechanically and electrically connected by umbilicals 61. Umbilical 61 may comprise electrical and/or optical conductors similar to those of wireline 60. The use of these sensors in the present invention will be described below.

Shown in FIG. 1 is a line labeled $T_{max}$ that indicates a well depth associated with the particular temperature gradient of the formations in FIG. 1 at which the electronics in seismic receivers 65 may cease to operate reliably if the electronic packages are allowed to reach that well bore temperature, $T_{max}$. In one example, $T_{max}$ is about 300 F. One skilled in the art will appreciate that the temperature gradient is site specific. Downhole tools use a number of techniques to allow operation at temperatures above the nominal ratings of the electronic components. These techniques may include, but are not limited to: placing the electronics in insulated dewar type flasks; using phase change materials as heat sinks to absorb thermal energy; and actively cooling devices such as thermoelectric coolers in contact with the electronics. However, even using these temperature management techniques, borehole temperatures above about 340° F. may exceed the capability of most high accuracy tools to provide reliable operation. For example, seismic geophones, as used herein, may use 24 bit analog to digital converters resulting in a resolution of 1 part in 16 million. The thermal drift of electronic components at high borehole temperatures may exceed this resolution, if the components work at all. In addition, the baseline noise in electronic circuits is typically temperature dependent such that the baseline noise at high bottomhole temperatures may cause significant measurement errors.

Still referring to FIG. 1, pump 40 may be used to pump a cooling fluid 90 from reservoir 35 down tubing string 50 to cool seismic receivers 65 and their associated electronics to a suitable temperature to allow the electronics to operate at an acceptable temperature during at least a portion of a fracturing operation.

Figure 2:
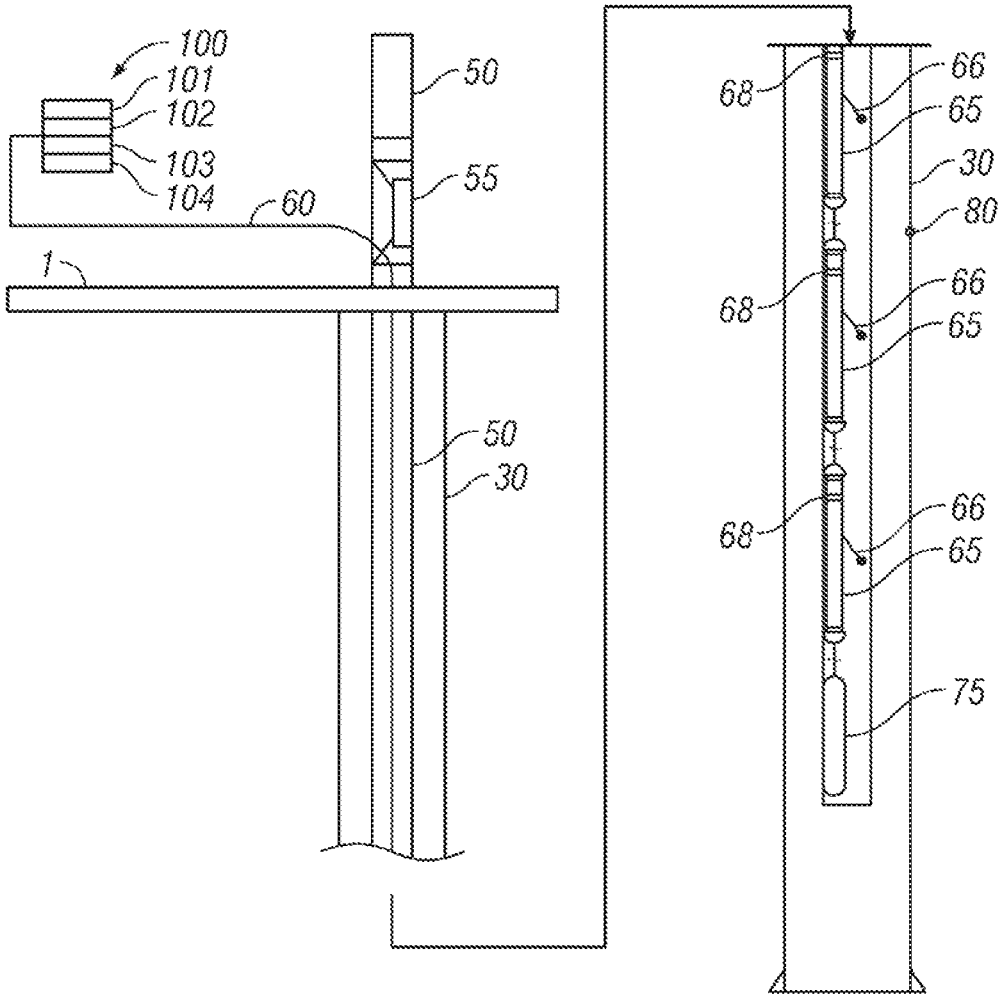
FIG. 2 shows an example of the deployment of one embodiment of a seismic receiver in a well.
Figure 3:
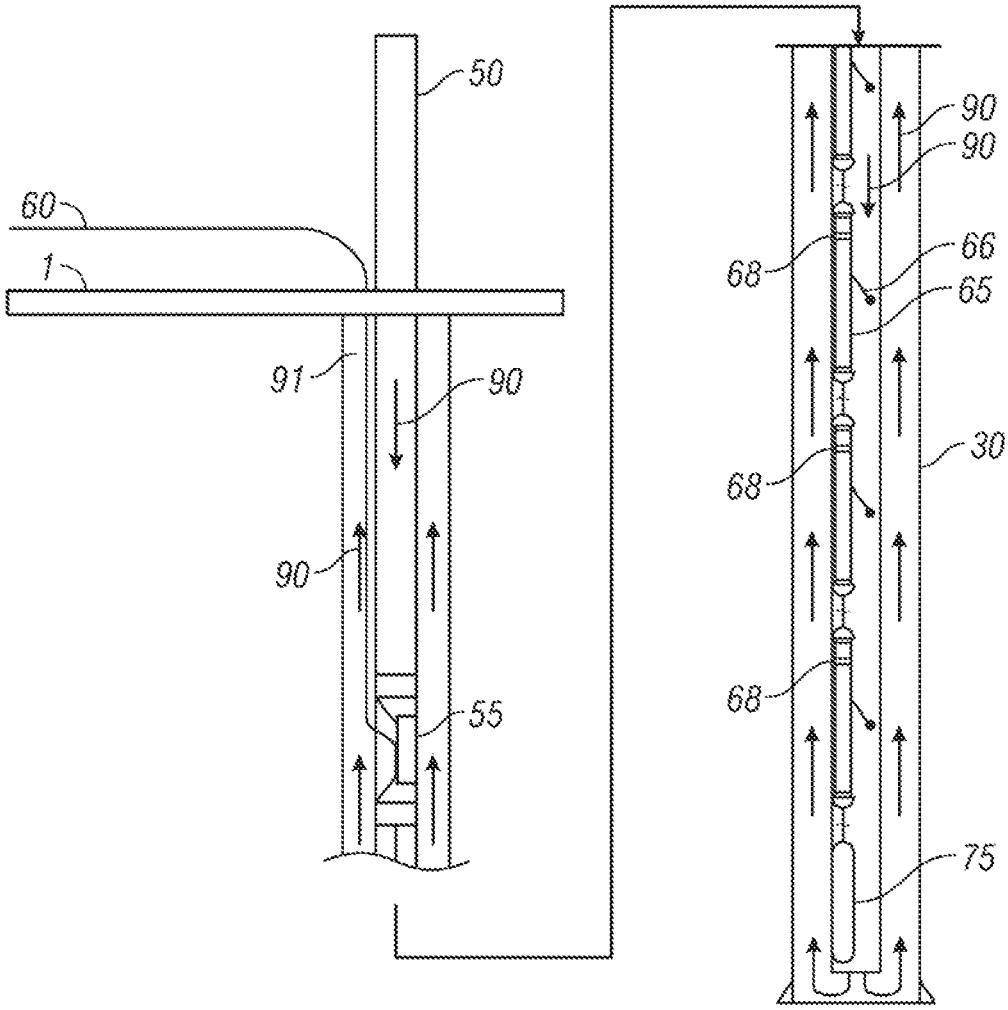
FIG. 3 shows an example for cooling down the seismic receiver of FIG. 2.
Figure 4:
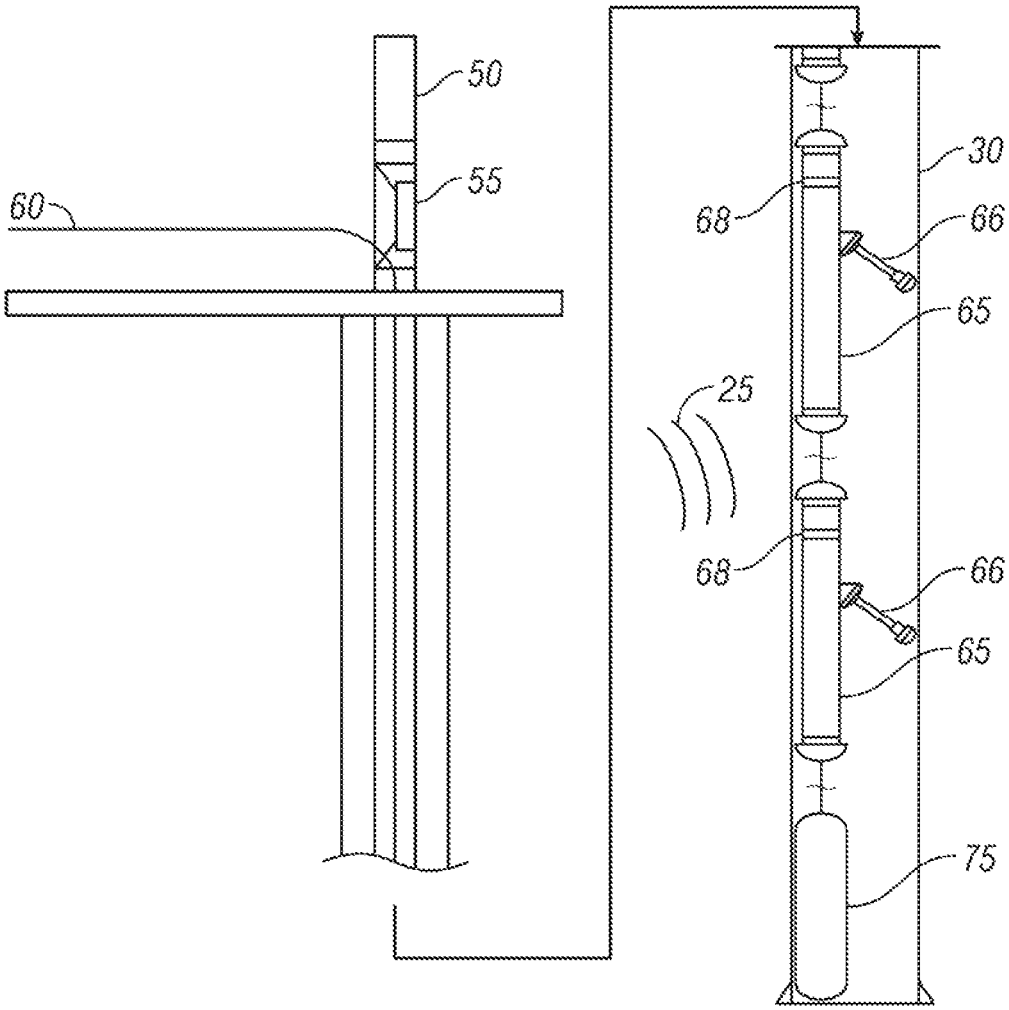
FIG. 4 shows an example of the measurement cycle of the seismic receiver of FIG. 2.

Referring also to FIGS. 2-4, one operational method for operating seismic receivers 65 in a high temperature well is described. As discussed previously, it is desirable to monitor microseismic emissions 25 from increased stress and fractures 20 in formation B during the fracturing of formation B surrounding wellbore 10. In FIG. 2, a string of seismic receivers 65 are located in tubing string 50 partially extending into casing 80 in target well 30. Wireline 60 is fed through sidewall sub 55, located at surface 1, and connected to the uppermost seismic receiver 65. Reel 70 (see FIG. 1) is omitted for clarity. Seismic receivers 65 are controlled by commands from surface controller 100 to actuate locking arms 66 and lock seismic receivers 65 and sensor sub 75 near the bottom end of tubing string 50.

Tubing sections are then added to the top of tubing string 50 to extend tubing string 50 to the bottom of offset well 30, as shown on FIG. 3. As shown, side entry sub 55 deploys below the surface 1 as tubing string 50 is extended into offset well 30. Note that, when extended to the bottom of offset well 30, at least a portion of the string of seismic receivers 65 is located in borehole temperatures greater than $T_{max}$. Surface controller 100 may selectively operate the temperature sensor in sensor sub 75 during deployment to monitor the wellbore temperature.

When tubing string 50 is at the appropriate operating location, coolant fluid 90 may be pumped down tubing 50 and back up annulus 91 to the surface 1. Coolant fluid 90 may be circulated, in one embodiment, until seismic receiver 65 temperature is at a predetermined value. When the predetermined temperature is reached, the locking arms 66 of seismic receivers are retracted and tubing string 50 is pulled back out of the hole a sufficient distance to allow seismic receivers 65 to drop out of tubing string 50 into casing 80 (see FIG. 4). Seismic receivers 65 are then clamped inside casing 80 by actuating locking arms 66 against the wall of casing 80. Substantially simultaneously, the fracturing process is initiated in well 10. In one example embodiment, emitted seismic signals 25 are detected and transmitted to surface controller 100 where they are processed and/or stored in data storage device 103. In one example, microseismic signal 25 data are detected until the temperature indicated in each seismic receiver 65 climbs above a predetermined allowable limit. Seismic receiver locking arms 66 may be released and tubing string 50 extended down over seismic receivers 65, and the cooling cycle may be repeated. One skilled in the art will appreciate that a number of fracturing cycles may make up a fracturing operation in a well.

Figure 5:
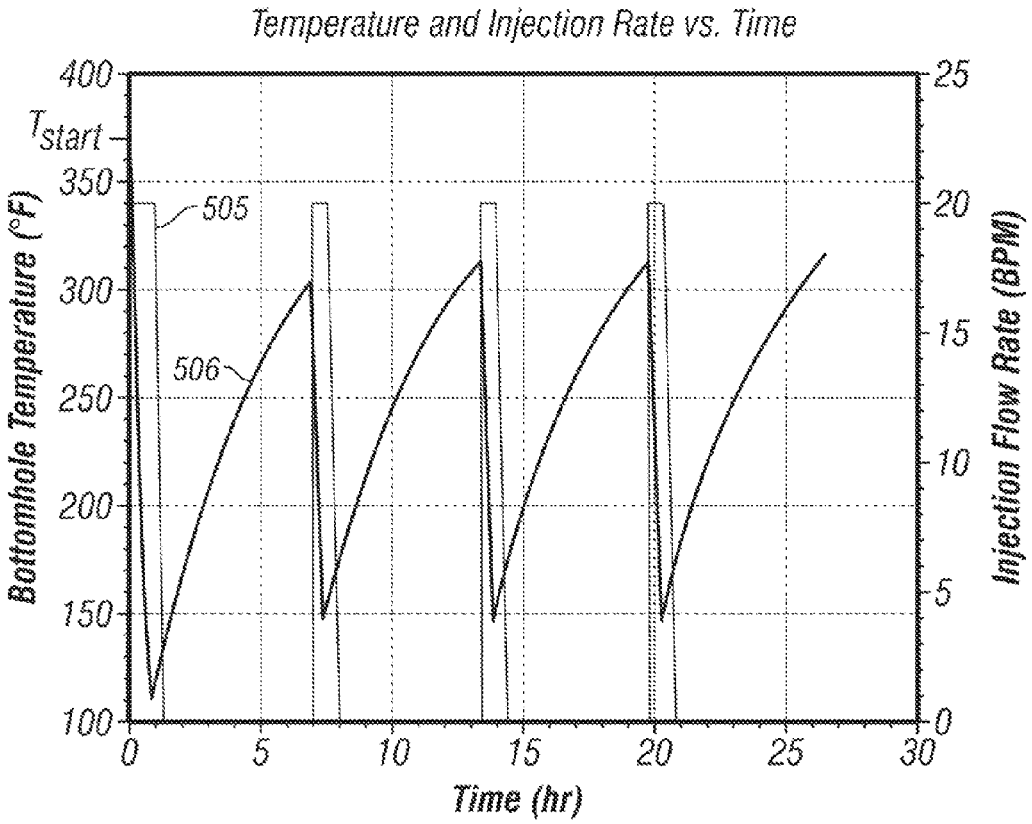
FIG. 5 shows results of one example of a calculation prediction of cool down and measurement cycles for a seismic receiver using a friction reduced cooling fluid.
Figure 6:
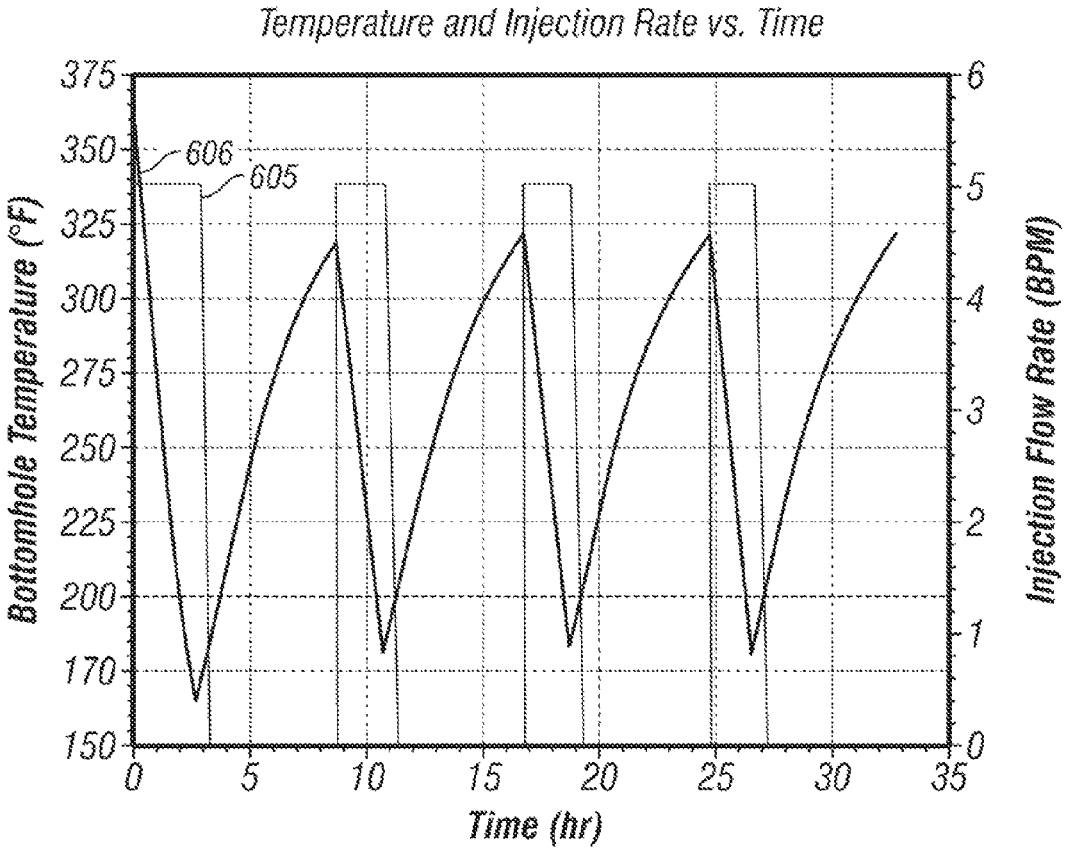
FIG. 6 shows results of another example of a calculation prediction of cool down and measurement cycles for a seismic receiver using a KCL brine solution as a cooling fluid.

In one embodiment, the cool down time and heat up cycles are modeled to provide parameters that allow microseismic signal detection time to substantially cover the fracturing time cycle. FIGS. 5 and 6 show the results of such a modeling approach to cover a six hour fracturing cycle. By modeling the heat transfer between cooling fluid 90, seismic receiver 65, and the formation surrounding offset well 30, an estimated time may be calculated for the cool down of seismic receiver 65 during coolant flow, and the subsequent heat up during the signal detection mode. Such modeling may be accomplished using closed solution convective heat transfer techniques. Alternatively, such a system may be modeled using commercially available computational fluid dynamics (CFD) programs, for example the Fluent brand of CFD programs marketed by ANSYS, Inc., Canonsburg, Pa. In one embodiment, programmed instructions for performing the thermal modeling may be programmed into memory 102 of surface controller 100 for onsite calculation of cool down and heat up predictions.

As one skilled in the art will appreciate, the thermal transport model will also depend on the coolant fluid properties. Coolants may comprise water, water based drilling fluids, water with a friction reducing agent, brines, and potassium chloride (KCl)-brine solutions. FIG. 5 presents calculated model results for a coolant fluid comprised of water with a friction reducing agent. The friction reducing agent modeled is designated as FR-56 available from Halliburton Company, Houston, Tex. While FR-56 is a proprietary material, it is anticipated that similar results may be obtained using other commercial friction reducing agents known in the art, without undue experimentation. Alternatively, any friction reducing agent usable at the temperatures anticipated may be used. As shown in FIG. 5, a coolant flow 505 at a rate of 20 barrels per minute (BPM) for one hour pumping down 2⅞" tubing and up the annulus in 5½" casing results in a cool down from about 380° F. to about 111° F., and a subsequent heat up that results in a temperature rise to about 305° F. after six hours of heat up, see temperature line 506.

FIG. 6 shows a similar modeling exercise using a 2% KCl-brine solution as a coolant. The KCl-brine coolant, as modeled, produces substantially more flow friction on the tools in the tubing than with the FR-56-water solution coolant. As a result the flow rate is reduced to prevent the load on the wireline from exceeding an allowable tension load. Therefore, the cool down flow 605 at a rate of 5 BPM for three hours results in a predicted cool down from 380° F. to 164° F., and a subsequent heat up that results in a temperature rise to about 319° F. after about six hours of heat up, see temperature line 606.

In one embodiment, a method for monitoring well fracturing in a target well comprises:

clamping a seismic sensor in a tubing string in a borehole of an offset well displaced from the target well;

extending the tubing string to a first position proximate a bottom of the well;

circulating coolant fluid through the tubing string for a predetermined time;

unclamping the seismic sensor and pulling the tubing up to a second location to expose the seismic sensor in the borehole of the offset well;

clamping the seismic sensor in the borehole of the offset well; and sensing a seismic signal emitted during a fracturing operation in the target well.

Figure 7:
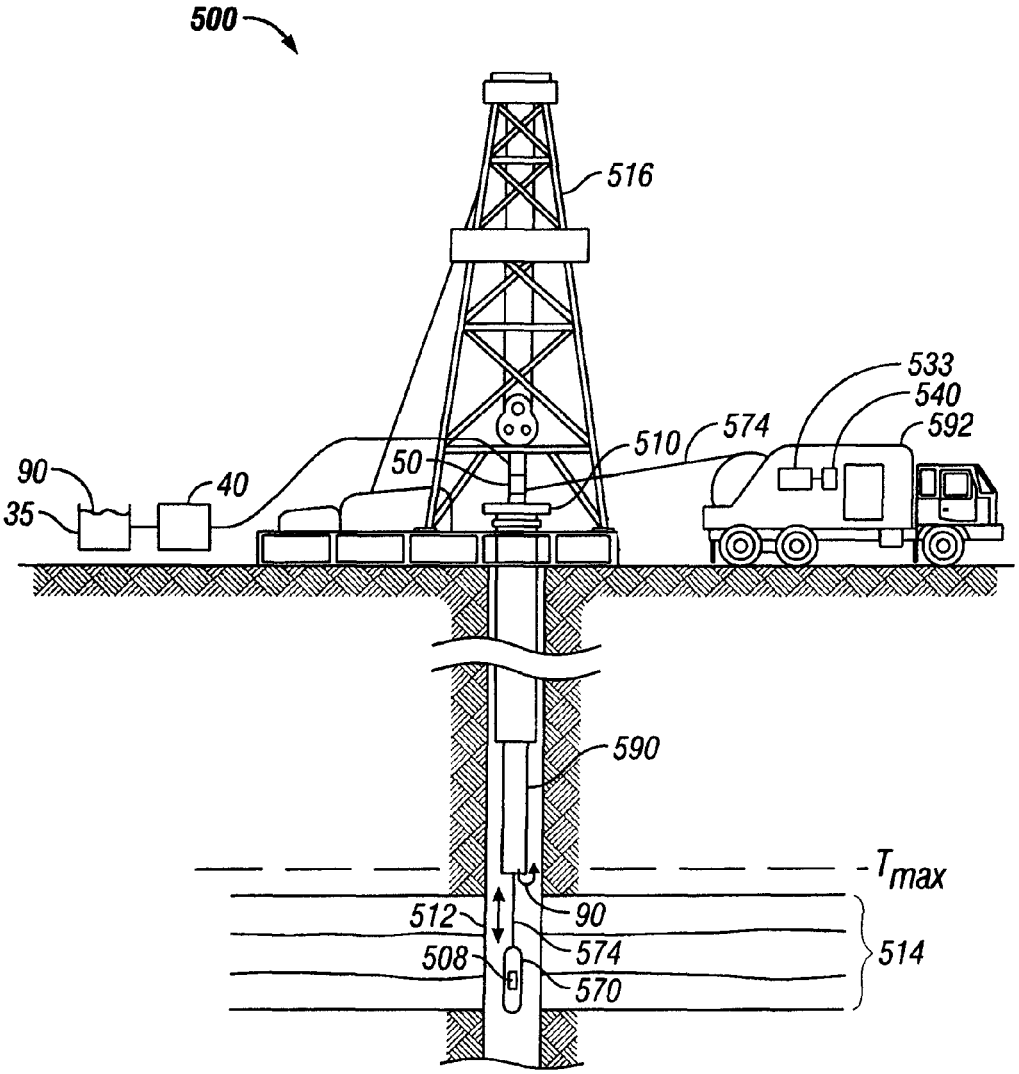
FIG. 7 shows a logging operation in a high temperature well.

While described above as relating to monitoring microseismic emissions during fracturing of formations, it is anticipated that such cooling techniques are similarly effective in logging high temperature wells using conventional logging tools. FIG. 7 illustrates an example of a wireline logging system 500. A derrick 516 supports a tubing string 590 that is lowered through a rotary table 510 into a wellbore or borehole 512. A wireline logging tool 570, such as a probe or sonde, is lowered by wireline or logging cable 574 into the tubing string and the tubing string may be lowered to the appropriate location for logging formation 514. The wireline logging cable 574 may have one or more electrical and/or optical conductors for communicating power and signals between the surface and the logging tool 570. The system is operated as described above. In FIG. 7, for example, logging tool 570 has been cooled by coolant fluid 90 and the tubing string 590 has been retracted such that logging tool 570 is exposed in the wellbore for logging high temperature formation 514. Logging sensors 508 located in the tool 570 may be used to perform measurements on the subsurface formations 514 adjacent the borehole 512. The sensors 508 may be selected to measure downhole parameters including, but not limited to, environmental parameters, directional drilling parameters, and formation evaluation parameters. Such parameters may comprise downhole pressure, downhole temperature, the resistivity or conductivity of the drilling mud and earth formations, the density and porosity of the earth formations, as well as the orientation of the wellbore. Sensor examples include, but are not limited to: a resistivity sensor, a nuclear porosity sensor, a nuclear density sensor, a magnetic resonance sensor, and a directional sensor package. In addition, formation fluid samples and/or core samples may be extracted from the formation using formation test tool. Such sensors and tools are known to those skilled in the art.

The measurement data can be communicated to 533 in logging unit 592 for storage, processing, and analysis. The logging facility 592 may be provided with electronic equipment for various types of signal processing. The log data may also be displayed at the rig site for use in the drilling and/or completion operation on display 540.

Numerous variations and modifications will become apparent to those skilled in the art. It is intended that the following claims be interpreted to embrace all such variations and modifications.

The invention claimed is:

1. A method for monitoring, a fracturing operation in a target well comprising:

a. extending at least two spaced apart seismic sensors in a tubing string to a first position in a well offset from the target well;

b. circulating a coolant fluid from the surface through the tubing string for a predetermined cooling time to cool the at least two seismic sensors;

c. retracting the tubing string to a second uphole position such that the cooled at least two seismic sensors are exposed in the offset well and stopping the coolant flow during a predetermined heat up time;

d. sensing a seismic signal emitted during the fracturing operation in the target well while the coolant circulation is stopped during the predetermined heat up time;

e. re-extending the tubing string over the at least two seismic sensors at the first position in the well after the predetermined heat up time;

f. restarting circulation of the cooling fluid from the surface through the tubing string for the predetermined cooling time to cool the at least two seismic sensors;

g. retracting the tubing string to the second uphole position such that the cooled at least two seismic sensors are exposed in the offset well and stopping the coolant flow during a predetermined heat up time;

h. sensing the seismic signal emitted during the fracturing operation in the target well while the coolant circulation is stopped during the predetermined heat up time; and i. repeating steps e-h until the fracturing operation is complete.

2. The method of claim 1 wherein the coolant fluid is selected from the group consisting of: water, a water based drilling fluid, water with a friction reducing agent, a brine, and a potassium chloride (KCl)-brine solution.

3. The method of claim 1 further comprising modeling the thermal transport process to determine the predetermined cooling time and the predetermined heat up time.

4. A method for monitoring a fracturing operation in a target well comprising:

a. extending at least two spaced apart seismic sensors in a tubing string to a first position in a well offset from the target well;

b. circulating a coolant fluid through the tubing string until a temperature sensor associated with at least one of the at least two seismic sensors reaches a predetermined cooled operating temperature;

c. retracting the tubing string to a second uphole position such that the at least two seismic sensors are exposed in the offset well and stopping the coolant circulation;

d. sensing a seismic signal emitted during the fracturing operation in the target well while the coolant circulation is stopped;

e. monitoring the temperature sensor associated with at least one of the at least two seismic sensors and determining when the sensed temperature reaches a predetermined maximum operating temperature;

f. re-extending the tubing string over the at least two seismic sensors at the first position in the well when the sensed temperature reaches the predetermined maximum allowable operating temperature;

g. restarting circulation of the coolant fluid through the tubing string until the sensed temperature reaches the predetermined cooled operating temperature;

h. retracting the tubing string to the second uphole position such that the at least two seismic sensors are exposed in the offset well and stopping the coolant flow;

i. sensing the seismic signal emitted during the fracturing operation in the target well while the coolant circulation is stopped until the sensed temperature exceeds the predetermined maximum allowable operating temperature; and j. repeating steps e-i until the fracturing operation is complete.

5. The method of claim 4 wherein the coolant fluid is selected from the group consisting of: water, a water based drilling fluid, water with a friction reducing agent, a brine, and a potassium chloride (KCl)-brine solution.

6. The method of claim 5 further comprising modeling the thermal transport process to determine a cool down time and a heat up time for a selected coolant.

7. A method for logging a high temperature well comprising:

a. extending at least one logging tool in a tubing string to a first position in the high temperature well;

b. circulating a coolant fluid through the tubing string until a temperature sensor associated with the logging tool reaches a predetermined cooled operating temperature;

c. retracting the tubing string to a second uphole position such that the at least one logging tool is exposed in the well and stopping the coolant circulation;

d. sensing a formation parameter of the surrounding formation while the coolant circulation is stopped;

e. monitoring the temperature sensor associated with the logging tool and determining when the sensed temperature reaches a predetermined maximum allowable operating temperature;

f. re-extending the tubing string over the logging tool at the first position when the sensed temperature reaches the predetermined maximum allowable operating temperature;

g. restarting circulation of the coolant fluid through the tubing string until the sensed temperature reaches the predetermined cooled operating temperature;

h. retracting the tubing string to the second uphole position such that the logging tool is exposed in the well and stopping the coolant circulation;

i. sensing the formation parameter in the well while the coolant circulation is stopped; and j. repeating steps e-i until the logging operation is complete.

8. The method of claim 7 wherein the coolant fluid is selected from the group consisting of: water, a water based drilling fluid, water with a friction reducing agent, a brine, and a potassium chloride (KCl)-brine solution.

9. The method of claim 7 wherein the logging tool is selected from the group consisting of: a resistivity tool, a nuclear porosity tool, a nuclear density tool, a magnetic resonance tool, a directional tool, and a formation test tool.

* * * * *